United States Patent [19]

Arditty et al.

[11] Patent Number: 5,039,220

[45] Date of Patent: Aug. 13, 1991

[54] OPTICAL FIBER MEASURING DEVICE, GYROMETER, CENTRAL NAVIGATION AND STABILIZING SYSTEM

[75] Inventors: Herve J. Arditty, Marly Le Roi; Philippe Martin, Pontchartrain; Francois X. Desforge, Fontenay Le Fleury; Phillipe Graindorge, Crimolois; Herve Lefevre, Paris, all of France

[73] Assignee: Phononetics, S.A., France

[21] Appl. No.: 406,335

[22] Filed: Sep. 13, 1989

[30] Foreign Application Priority Data

Sep. 14, 1988 [FR] France ..... 8811987

[51] Int. Cl.[5] ..... G01B 9/02

[52] U.S. Cl. ..... 356/345; 356/350

[58] Field of Search ..... 356/345, 350

[56] References Cited

U.S. PATENT DOCUMENTS 4,705,399 11/1987 Graindorge et al. ..... 356/350

4,872,754 10/1989 Ensley ..... 356/350

FOREIGN PATENT DOCUMENTS 2152207A 7/1985 United Kingdom .

*Primary Examiner*—Davis L. Willis

*Assistant Examiner*—Matthew W. Koren

*Attorney, Agent, or Firm*—Mason, Fenwick & Lawrence

[57] ABSTRACT

The invention relates to an optical fiber measuring device of the type in which variation of a measured parameter causes a difference of progression of light waves in the optical fiber. Such a device permits measurement of speed of rotation, or of current and magnetic field. The device includes an electronic device for digitally processing a signal indicative of phase shift of one light wave relative to another, the light waves propagating through a preferably monomode optical fiber in a SAGNAC ring interferometer, modulated by a phase modulator. The electronic device includes an analog-digital converter 11, a digital processing system 12 for generating a processor signal reduced to a frequency of modulation around the optical fiber, a control loop digital filter 13 for supplying a parameter indication signal, a register 14 for receiving the parameter indication signal and supplying a register signal which is a function of the measured parameter, an accumulator 15 for generating a digital feedback signal which is a function of the measured parameter, and a digital-analog converter 16 for generating an analog feedback signal for controlling the phase modulator.

24 Claims, 2 Drawing Sheets

OPTICAL FIBER MEASURING DEVICE, GYROMETER, CENTRAL NAVIGATION AND STABILIZING SYSTEM

BACKGROUND OF THE INVENTION

The invention relates to an optical-fiber measuring device permitting the measurement of the variation of a parameter which produces non-reciprocal disturbances in a SAGNAC ring interferometer.

The SAGNAC interferometer and the physical phenomena which it utilizes are well known. In such an interferometer, a beam splitter or some other separating device divides an incident wave. The two oppositely propagating waves thus created propagate in opposite directions along a closed optical path, recombine and generate interferences which are dependent upon the phase shift of the waves in the course of their recombination.

Originally, the closed optical path of the SAGNAC interferometers was defined by mirrors. It is now known that it can be formed by a multi-turn coil of monomode optical fibre.

It is likewise known that certain physical phenomena are capable of producing disturbances, particularly phase shifts, which are non-reciprocal, on the oppositely propagating waves giving rise to a relative phase shift of these waves which modify their state of interference in the course of their recombination.

The measurement of this relative phase shift permits the quantification of the physical phenomenon which has given rise to it.

The principal physical phenomenon capable of creating these non-reciprocal disturbances is the SAGNAC effect produced by the rotation of the interferometer in relation to an axis perpendicular to the plane of its closed optical path. The FARADAY effect, or collinear magneto-optical effect, is likewise known as producing non-reciprocal effects of this type. This has, for example, been described in an article in the journal Optic Letters (Vol. 7, No. 4, Apr. 1982, pages 180–182) by K. BöHM. Under certain conditions, other effects may likewise produce a non-reciprocal phase shift.

On the other hand, the variations of numerous parameters representing the environment which frequently give rise to disturbances of the measurements have only reciprocal effects on the SAGNAC interferometer, do not disturb the relative phase shift between the oppositely propagating waves and therefore have no influence on the measurement of the parameter under investigation. This is so in the case of slow variations of temperature, of indices etc. . . which modify the optical path traversed by the waves, but modify it in a reciprocal manner.

Numerous projects have been undertaken for the purpose of improving the sensitivity and the precision of the measurements which can be made with such a measuring apparatus. It will be possible, for example, to consult the document GB 2 152 207 and the publication Electronics Letters (Vol. 19 No. 23, Nov. 1983 pages 997–999, an article by K. BöHM).

In particular, it has first of all been found that the response provided by the SAGNAC interferometer is of the form $P=Po(1+\cos.\ \Delta\phi)$ and thus that the sensitivity of this signal close to the phase difference $\Delta\phi=0$ is low. It has been proposed to introduce a phase difference modulation, squared with an amplitude of plus or minus $\pi/2$ for example, which displaces the operating point and produces a periodic signal, the amplitude of which is a sinusoidal function of the measured parameter and which it is therefore possible to use with a greater sensitivity and stability.

It was then shown that the precision of the measurement is improved by the use of a zero method which is likewise referred to as closed-loop operation. According to this method, a supplementary phase shift referred to as a feedback phase shift $\Delta\phi_A$ is applied and serves to compensate the phase shift $\Delta\phi_B$ produced by the measured parameter. The sum of these two phase shifts $\Delta\phi_A$ and $\Delta\phi_B$ is maintained at zero; this permits the interferometer to be operated with the maximum precision. The measurement is made by use of the signal required for the production of the feedback phase shift $\Delta\phi_A$. Thus, the measurement is stable and linear.

The control may be produced by generating phase progressions of a height $\Delta\phi_A$ at each time $\tau$, $\tau$ being the propagation time in the coil, the phase modulator or modulators being placed at the ends of the coil.

The European Patent EP 0,168,292 describes such a measuring system. According to the device which it proposes, the signal produced by variation of the measured parameter produces a variation of the output signal of the detector. The amplitude of this variation is extracted by circuits for analog synchronous detection which, after analog processing by a DIP (differential, integral, proportional) filter, conventionally ensures the stability of the control loop. An analog-digital converter gives the digital value of the progression $\Delta\phi_A$ which has been introduced in order to ensure the compensation, and there are added a control signal generator, the purpose of which is to formulate a digital ramp in steps, and finally a digital-analog converter which generates the drive signal returning from the phase modulator, on the basis of this ramp.

In seeking a maximum sensitivity and precision of the measurement, the devices of the prior art exhibit certain disadvantages:

- An analog synchronous detection (also referred to as demodulation) generally involves a zero drift at the output which is reflected in an error in the measurement.
- The analog-digital converter required to construct this device must be able to process the compensation phase shift directly. It must include a number of bits linked to the maximum amplitude of the signal at its input; this leads, in practice, in order that it should not limit the precision of the measurement, to an analog-digital converter including a number of bits of the order of 18.

SUMMARY OF THE INVENTION

The object of the present invention is therefore to improve the precision and the sensitivity of a measuring device based on a SAGNAC ring interferometer incorporating a monomode optical fiber.

It is likewise an object in such a measuring device to overcome any possible zero drifts.

It is a further object of the present invention to permit the obtaining of a measurement of quality equal to or greater than that available by the device of the prior art with a less sophisticated analog-digital converter.

In order to achieve these objects, the subject of the invention is an optical-fiber measuring device of the type in which the variation of a parameter causes a difference of phase, comprising a quasi-monochromatic light source, a SAGNAC ring interferometer incorporating a monomode optical fiber, a detector, a phase modulator, a polarizer and a spatial filter which are placed between the source and the interferometer, electronic means controlling in feedback the phase modulator as a function of the signal received from the detector in such a manner that, on the one hand, the variation of the demodulated error signal as a function of the difference of phase close to the zero is sinusoidal, and that, on the other hand, this difference of phase is maintained at zero, and supplying, by utilizing the control signal of the modulator, a signal which is a function of the variation of the measured parameter.

In such a device, it is proposed that the said electronic means comprise an analog-digital converter intended to digitalize the signal originating from the detector, a digital processing system utilizing the signal supplied by the analog-digital converter and reducing its component to the frequency of the modulation around the continous, a control loop digital filter supplied by the signal emerging from the digital processing system, supplying a signal representing the measured parameter, a register receiving the signal emerging from the control loop digital filter and supplying a signal which is a function of the measured parameter for any desired external use, an accumulator supplied by the signal emerging from the register, generating a digital ramp, the slope of which is a function of the measured rotation, a digital-analog converter supplied by the feedback signal that can be a ramp emanating from the accumulator and controlling the phase modulator.

The subject of the invention is also a gyrometer in accordance with the measuring device defined hereinabove in which the measured parameter is the speed of rotation of the interferometer about its axis.

The subject of the invention is furthermore a central inertial stabilization or navigation system comprising at least one gyrometer as defined hereinabove.

BRIEF DESCRIPTION OF THE DRAWINGS

The invention will be better understood on reading the description which will follow, which is given with reference to the drawings, in which.

Figure 1:
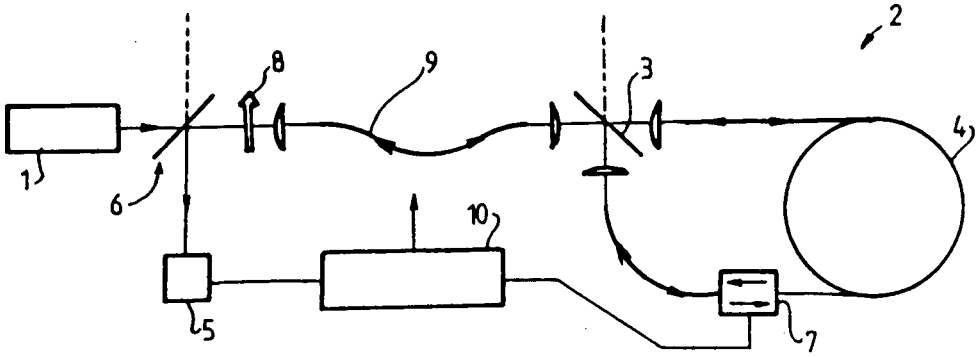
FIG. 1 is a known measuring device based on a SAGNAC ring interferometer.

The optical-fiber measuring device of the invention comprises a quasi-monochromatic light source 1 which is most frequently a laser or a super luminescent diode, and a SAGNAC ring interferometer incorporating a monomode optical fibre, which interferometer is designated overall by the reference 2.

This ring interferometer 2 comprises a beam splitter 3 ensuring the separation of the waves at the entrance of the interferometer, and then their recombination at the exit, and a closed optical path 4 consisting of a monomode optical fibre wound up on itself.

This measuring device further comprises a detector 5 supplying a signal which is a function of the state of interference of the waves at the exit of the interferometer itself.

The optical signal is supplied to the detector 5 via a beam splitter 6, for example consisting of a semi-transparent plate.

The interferometer is adjusted in such a manner that the waves are parallel in the course of their recombination, the signal supplied by the detector thus being a function of the phase shift between these two waves.

On the optical path of the interferometer there is interposed a modulator 7 which, being controlled on the basis of an electrical signal, is capable of introducing a given phase shift of the two waves. The operation of the interferometer is improved by interposing between the light source 1 and the entrance of the ring, that is to say the beam splitter 3, a polarizer 8 and a spatial filter 9. This spatial filter is composed of a monomode optical fiber.

In the text which follows, we shall use without distinction the terms "phase shift" and "difference of phase" to designate the physical effects produced in the interferometer.

Electronic means 10 control in feedback the phase modulator 7, as a function of the signal received from the detector 5.

These electronic means 10 are designed in such a manner that, on the one hand, the variation of the demodulated error signal as a function of the difference of progression produced between the two waves close to the zero is sinusoidal. This arrangement permits a very good sensitivity of the variation of the demodulated error signal close to the zero of the difference of progression to be obtained, while it can easily be understood that, when the dependency of the signal in relation to the difference of phase is of cosinusoidal form, the sensitivity close to the zero of the difference of phase is very low.

On the other hand, the function of these electronic means 10 is to maintain the difference of phase at zero. That is to say that, when the variation of the measured parameter introduces a phase shift between the two waves in the interferometer, this phase shift produces a variation of the signal emitted by the detector 5 involving, via the electronic means 10 and the phase modulator 7, an action equal and of opposite direction to the phase shift initially produced in such a manner that the total phase shift is reduced to the value 0.

Finally, these electronic means 10 supply, by use of the control signal of the phase modulator 7, a signal which is a function of the variation of the measured parameter.

According to the invention, the electronic means 10 comprise an analog-digital converter 11 intended to digitalize the signal emitted by the detector. The digital signal emanating from this analog-digital converter is transmitted to a digital processing system 12 utilizing this signal and reducing its component to the frequency of modulation around the continuous in such a manner as to extract the genuinely significant signal. It is a significant element of the invention to carry out the digitalization of the signal at the output of the detector before carrying out its digital processing.

The electronic means 10 comprise a control loop digital filter 13 which is supplied by the low signal emerging from the digital processing system which ensures an operation with low error, low response time and good stability of the control. This may be a digital accumulator. This filter 13 supplies a signal representing the measured parameter.

The electronic means 10 comprise a register 14 receiving the signal emerging from the digital filter 13 supplying a signal which is a function of the measured parameter for any desired external use.

An accumulator (15) supplied by the signal emerging from the register (14) generates a feedback signal which is a function of the measured parameter.

Preferably, the feedback signal is a digital ramp 17, the slope of which is a function of the measured parameter. After addition of a modulation by the digital adder 18, a digital-analog converter 16 supplied by the ramp signal 17 emanating from the accumulator 15 controls the phase modulator 7.

The operation of the measuring device of the invention is the following: when the measured parameter is stable, the electronic control means 10 introduce, via the phase modulator 7, a constant amplitude modulation of the phase shift between the oppositely propagating waves within the ring 4. The detector 5 thus produces a modulated signal which is digitalized by the converter 11 and then processed by the digital processing system 12, which supplies a zero signal to the accumulator 15 maintaining the register 14 at a constant value; this maintains the ramp 17 in its condition and thus maintains the signal supplied to the modulator 7. It is thus verified that this condition is stable.

In the course of a variation of the measured parameter, a constant phase shift is superposed on the periodic phase shift corresponding to the stable condition between the oppositely propagating waves at the location of the ring 4. The signal then supplied by the detector 5 after digitalization by the sampler 11 and processing by the digital processing system 12 thus has a level different from zero which produces a supply at the location of the accumulator 15 and a variation of the parameter register 14. This variation involves a modification of the ramp generated at the location 15 and thus of the phase shift introduced by the modulator 7, thus reducing the phase shift between the oppositely propagating waves at the output of the ring 4 to a zero value with the exception of the periodic modulation mentioned hereinabove.

It is thus understood that the sampling proposed according to the invention before the digital processing is applied to a signal which is a function of the variation of the measured parameter and not of the absolute value of this parameter. This permits the utilization of a sampler processing a number of bits which is limited, for example 8, while still maintaining the precision and the quality of the measurement.

According to a preferred embodiment, the digital processing system 12 of the invention classifies alternately the digitalized samples in two classes, of which it forms the digital mean values, which it then compares in order to deduce the error signal therefrom. This arrangement permits the avoidance of the effects of a possible zero drift. Such an arrangement is made possible by the digitalization of the signal before its digital processing.

The neutralization of this drift is all the more important as in this type of measuring apparatus there is frequently performed an integration of the measured parameter over a long period which is very sensitive to the zero drifts.

Figure 3:
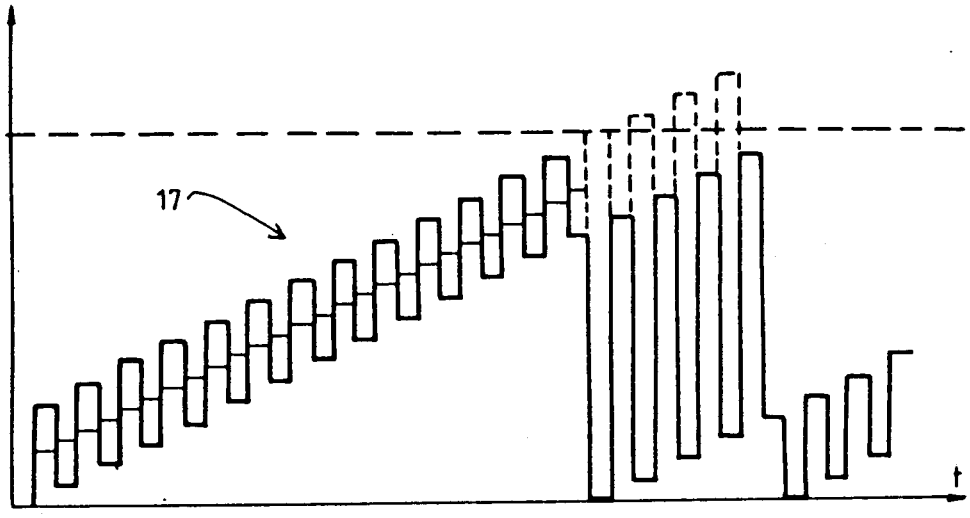
FIG. 3 represents the analog modulation signal resulting after conversion from the digital addition of the feedback signal in the particular case of a ramp and of the squared modulation.
Figure 2:
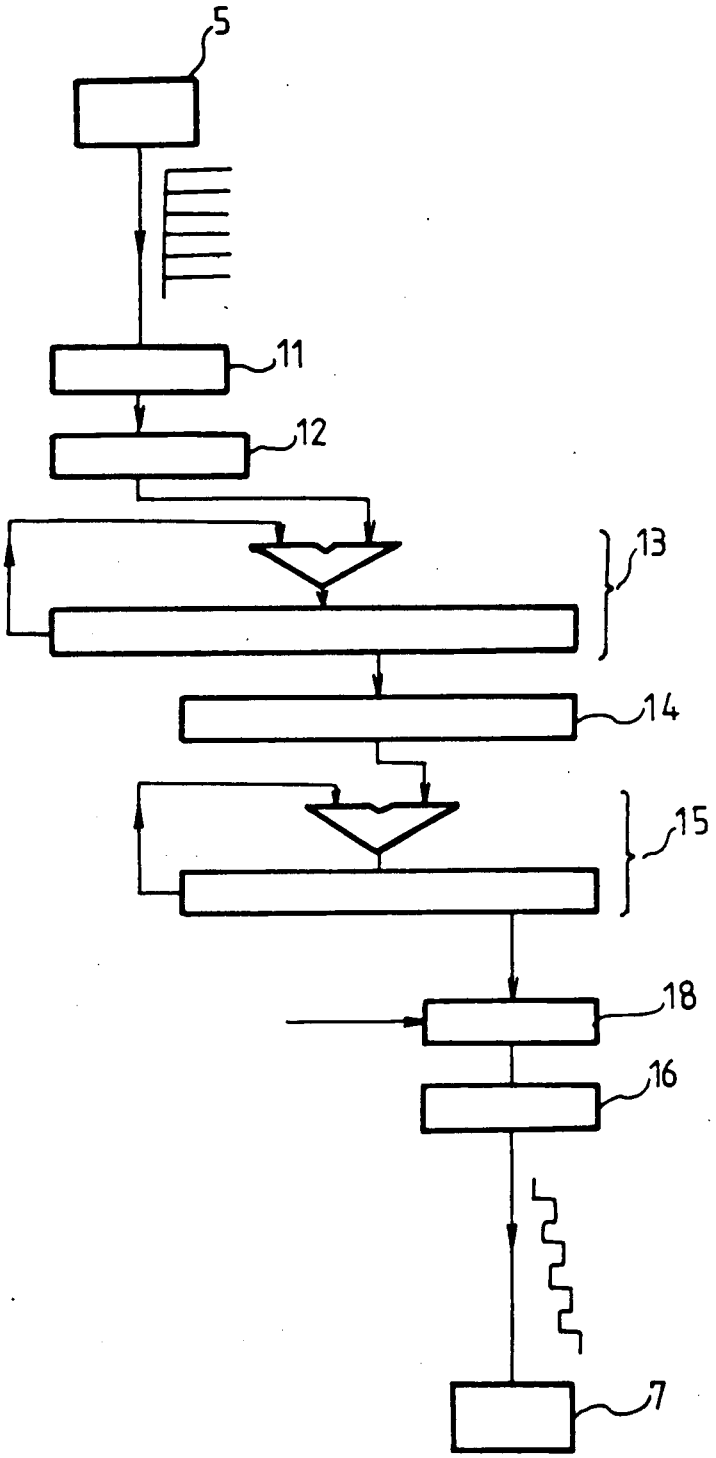
FIG. 2 represents the electronic means for the digital processing of the signal according to the invention.

FIG. 3 shows the digital addition of the ramp and of the squared modulation 17 which makes up the excitation signal formulated by the electronic means 10 in order to control the phase modulator 7, in a condition in which the measured parameter is constant. On this graph, time is represented as abscissa and the phase shift as ordinate. The value of the measured parameter is a function of the phase shift existing between two successive periods of the squared function. The right hand part of this graph represents the phenomena known per se which take place in the course of overflow of a register used in the course of the generation of the ramp.

According to a preferred embodiment, the measuring device of the invention is characterized in that the sampler operates at an approximate frequency of 1 MHz for a fibre length equal to approximately 200 m.

Under such conditions, the device of the invention which permits the reduction of the sampling dynamics permits the use of a, for example, 8-bit analog-digital converter, while the register 14 containing the value of the measured parameter ensures a precision corresponding to its size which is of approximately 17 to 26 bits.

The construction of a register of this size represents only a slight constraint since, in wired logic, it can be obtained with a plurality of adders, for example parallel 8-bit adders.

The measuring device of the invention is particularly well suited to the construction of a gyrometer. In this case, the measured parameter is the speed of rotation of the interferometer about its axis.

This gyrometer is advantageously included in the construction of inertial stabilization or navigation control systems.

Such an arrangement is likewise very well suited to the construction of the device for measuring magnetic fields and electric current utilizing the FARADAY effect.

We claim:

1. An optical fiber device of the type in which variation of a parameter causes a difference of phase, the device comprising:

(a) a quasi-monochromatic light source;

(b) a SAGNAC ring interferometer receiving light energy from the light source, and including an optical fiber for carrying light waves;

(c) a detector, responsive to the waves from the interferometer, for producing a detector signal;

(d) a phase modulator, connected to the interferometer for modulating the phase of the wave(s) travelling through the interferometer;

(e) a polarizer and a spatial filter which are placed between the light source and the interferometer; and (f) an electronic means for controlling the phase modulator as a function of the detector signal in such a manner that:

(i) the variation of a demodulated error signal as a function of the difference of phase close to zero is sinusoidal; and (ii) this difference of phase is maintained at zero;

wherein the electronic means supplies a parameter indication signal which is a function of the variation of the measured parameter; and wherein the electronic means includes:

(1) an analog-digital converter responsive to the detector for digitizing the detector signal and generating a digitized detector signal;

(2) a digital processing system, responsive to the analog-digital converter for utilizing the digitized detector signal and generating a processor signal reduced to a frequency of modulation around the optical fiber;

(3) a control loop digital filter, responsive to the processor signal, for supplying the parameter indication signal;

(4) a register for receiving the parameter indication signal and supplying a register signal which is a function of the measured parameter;

(5) an accumulator, responsive to the register signal, for generating a digital feedback signal which is a function of the measured parameter; and (6) a digital-analog converter, responsive to the digital feedback signal, for generating an analog feedback signal for controlling the phase modulator.

2. The measuring device according to claim 1, wherein:

the digital processing system includes means to alternately classify the digitized detector signal into two classes;

means for forming mean values of the classes; and means for comparing the mean values to generate the demodulated error signal.

3. The measuring device according to claim 2, wherein:

the digital feedback signal is a digital ramp having a slope which is a function of the measured parameter.

4. The measuring device according to claim 1, wherein:

the analog-digital converter operates at an approximate frequency of 1 MHz, corresponding to a sampling time of 1 $\mu$s; and the fiber has a length equal to approximately 200 m.

5. The measuring device according to claim 1, wherein:

the register contains from 17 to 26 bits; and the sampler contains from 7 to 9 bits.

6. The measuring device of claim 1, wherein the electronic means further comprises:

an adder, responsive to the digital feedback signal from the accumulator, for modulating the digital feedback signal before it is input to the digital-analog converter.

7. An optical-fiber gyrometer comprising:

(a) a quasi-monochromatic light source;

(b) a SAGNAC ring interferometer receiving light energy from the light source, and including an optical fiber for carrying light waves;

(c) a detector, responsive to the waves from the interferometer, for producing a detector signal;

(d) a phase modulator, connected to the interferometer for modulating the phase of the wave(s) travelling through the interferometer;

(e) a polarizer and a spatial filter which are placed between the light source and the interferometer; and (f) an electronic means for controlling the phase modulator as a function of the detector signal in such a manner that:

(i) the variation of a demodulated error signal as a function of the difference of phase close to zero is sinusoidal; and (ii) this difference of phase is maintained at zero;

wherein the electronic means supplies a rotational speed signal which is a function of the speed of rotation of the interferometer about an axis perpendicular to a plane of the optical fiber; and wherein the electronic means includes:

(1) an analog-digital converter responsive to the detector for digitizing the detector signal and generating a digitized detector signal;

(2) a digital processing system, responsive to the analog-digital converter for utilizing the digitized detector signal and generating a processor signal reduced to a frequency of modulation around the optical fiber;

(3) a control loop digital filter, responsive to the processor signal, for supplying the rotational speed indication signal;

(4) a register for receiving the rotational speed indication signal and supplying a register signal which is a function of the speed of rotation;

(5) an accumulator, responsive to the register signal, for generating a digital feedback signal which is a function of the speed of rotation; and (6) a digital-analog converter, responsive to the digital feedback signal, for generating an analog feedback signal for controlling the phase modulator.

8. The optical-fiber gyrometer of claim 7, wherein the electronic means further comprises:

an adder, responsive to the digital feedback signal from the accumulator, for modulating the digital feedback signal before it is input to the digital-analog converter.

9. An inertial stabilization or navigation control system comprising:

(I) at least one optical-fiber gyrometer, each optical fiber gyrometer including:

(a) a quasi-monochromatic light source;

(b) a SAGNAC ring interferometer receiving light energy from the light source, and including an optical fiber for carrying light waves;

(c) a detector, responsive to the waves from the interferometer, for producing a detector signal;

(d) a phase modulator, connected to the interferometer for modulating the phase of the wave(s) travelling through the interferometer;

(e) a polarizer and a spatial filter which are placed between the light source and the interferometer; and (f) an electronic means for controlling the phase modulator as a function of the detector signal in such a manner that:

(i) the variation of a demodulated error signal as a function of the difference of phase close to zero is sinusoidal; and (ii) this difference of phase is maintained at zero;

wherein the electronic means supplies a rotational speed signal which is a function of the speed of rotation of the interferometer about an axis perpendicular to a plane of the optical fiber; and wherein the electronic means includes:

(1) an analog-digital converter responsive to the detector for digitizing the detector signal and generating a digitized detector signal;

(2) a digital processing system, responsive to the analog-digital converter for utilizing the digitized detector signal and generating a processor signal reduced to a frequency of modulation around the optical fiber;

(3) a control loop digital filter, responsive to the processor signal, for supplying the rotational speed indication signal;

(4) a register for receiving the rotational speed indication signal and supplying a register signal which is a function of the speed of rotation;

(5) an accumulator, responsive to the register signal, for generating a digital feedback signal which is a function of the speed of rotation; and (6) a digital-analog converter, responsive to the digital feedback signal, for generating an analog feedback signal for controlling the phase modulator.

10. The system of claim 9, wherein the electronic means further comprises:

an adder, responsive to the digital feedback signal from the accumulator, for modulating the digital feedback signal before it is input to the digital-analog converter.

11. A current and magnetic-field sensor incorporating an optical in which a variation of difference of progression is produced by a measured parameter by the Faraday effect, the sensor comprising:

(a) a quasi-monochromatic light source;

(b) a SAGNAC ring interferometer receiving light energy from the light source, and including an optical fiber for carrying light waves;

(c) a detector, responsive to the waves from the interferometer, for producing a detector signal;

(d) a phase modulator, connected to the interferometer for modulating the phase of the wave(s) travelling through the interferometer;

(e) a polarizer and a spatial filter which are placed between the light source and the interferometer; and (f) an electronic means for controlling the phase modulator as a function of the detector signal in such a manner that:

(i) the variation of a demodulated error signal as a function of the difference of phase close to zero is sinusoidal; and (ii) this difference of phase is maintained at zero;

wherein the electronic means supplies a parameter indication signal which is a function of the variation of the measured parameter; and wherein the electronic means includes:

(1) an analog-digital converter responsive to the detector for digitizing the detector signal and generating a digitized detector signal;

(2) a digital processing system, responsive to the analog-digital converter for using the digitized detector signal and generating a processor signal reduced to a frequency of modulation around the optical fiber;

(3) a control loop digital filter, responsive to the processor signal, for supplying the parameter indication signal;

(4) a register for receiving the parameter indication signal and supplying a register signal which is a function of the measured parameter;

(5) an accumulator, responsive to the register signal, for generating a digital feedback signal which is a function of the measured parameter; and (6) a digital-analog converter, responsive to the digital feedback signal, for generating an analog feedback signal for controlling the phase modulator.

12. The sensor of claim 11, wherein the electronic means further comprises:

an adder, responsive to the digital feedback signal from the accumulator, for modulating the digital feedback signal before it is input to the digital-analog converter.

13. An optical fiber device of the type in which variation of a parameter causes a difference of phase, the device comprising:

(a) a quasi-monochromatic light source;

(b) a SAGNAC ring interferometer receiving light energy from the light source, and including a monomode optical fiber for carrying light waves;

(c) a detector, responsive to the waves from the interferometer, for producing a detector signal;

(d) a phase modulator, connected to the interferometer for modulating the phase of the wave(s) travelling through the interferometer;

(e) a polarizer and a spatial filter which are placed between the light source and the interferometer; and (f) an electronic means for controlling the phase modulator as a function of the detector signal in such a manner that:

(i) the variation of a demodulated error signal as a function of the difference of phase close to zero is sinusoidal; and (ii) this difference of phase is maintained at zero;

wherein the electronic means supplies a parameter indication signal which is a function of the variation of the measured parameter; and wherein the electronic means includes:

(1) an analog-digital converter responsive to the detector for digitizing the detector signal and generating a digitized detector signal;

(2) a digital processing system, responsive to the analog-digital converter for utilizing the digitized detector signal and generating a processor signal reduced to a frequency of modulation around the optical fiber;

(3) a control loop digital filter, responsive to the processor signal, for supplying the parameter indication signal;

(4) a register for receiving the parameter indication signal and supplying a register signal which is a function of the measured parameter;

(5) an accumulator, responsive to the register signal, for generating a digital feedback signal which is a function of the measured parameter; and (6) a digital-analog converter, responsive to the digital feedback signal, for generating an analog feedback signal for controlling the phase modulator.

14. The measuring device according to claim 13, wherein:

the digital processing system includes means to alternately classify the digitized detector signal into two classes;

means for forming mean values of the classes; and means for comparing the mean values to generate the demodulated error signal.

15. The measuring device according to claim 14, wherein:

the digital feedback signal is a digital ramp having a slope which is a function of the measured parameter.

16. The measuring device according to claim 13, wherein:

the analog-digital converter operates at an approximate frequency of 1 MHz, corresponding to a sampling time of 1 $\mu$s; and the fiber has a length equal to approximately 200 m.

17. The measuring device according to claim 13, wherein:

the register contains from 17 to 26 bits; and the sampler contains from 7 to 9 bits.

18. The measuring device of claim 13, wherein the electronic means further comprises:

an adder, responsive to the digital feedback signal from the accumulator, for modulating the digital feedback signal before it is input to the digital-analog converter.

19. An optical-fiber gyrometer comprising:

(a) a quasi-monochromatic light source;

(b) a SAGNAC ring interferometer receiving light energy from the light source, and including a monomode optical fiber for carrying light waves;

(c) a detector, responsive to the waves from the interferometer, for producing a detector signal;

(d) a phase modulator, connected to the interferometer for modulating the phase of the wave(s) travelling through the interferometer;

(e) a polarizer and a spatial filter which are placed between the light source and the interferometer; and (f) an electronic means for controlling the phase modulator as a function of the detector signal in such a manner that:

(i) the variation of a demodulated error signal as a function of the difference of phase close to zero is sinusoidal; and (ii) this difference of phase is maintained at zero;

wherein the electronic means supplies a rotational speed signal which is a function of the speed of rotation of the interferometer about an axis perpendicular to a plane of the optical fiber; and wherein the electronic means includes:

(1) an analog-digital converter responsive to the detector for digitizing the detector signal and generating a digitized detector signal;

(2) a digital processing system, responsive to the analog-digital converter for utilizing the digitized detector signal and generating a processor signal reduced to a frequency of modulation around the optical fiber;

(3) a control loop digital filter, responsive to the processor signal, for supplying the rotational speed indication signal;

(4) a register for receiving the rotational speed indication signal and supplying a register signal which is a function of the speed of rotation;

(5) an accumulator, responsive to the register signal, for generating a digital feedback signal which is a function of the speed of rotation; and (6) a digital-analog converter, responsive to the digital feedback signal, for generating an analog feedback signal for controlling the phase modulator.

20. The optical-fiber gyrometer of claim 19, wherein the electronic means further comprises:

an adder, responsive to the digital feedback signal from the accumulator, for modulating the digital feedback signal before it is input to the digital-analog converter.

21. An inertial stabilization or navigation control system comprising:

(I) at least one optical-fiber gyrometer, each optical fiber gyrometer including:

(a) a quasi-monochromatic light source;

(b) a SAGNAC ring interferometer receiving light energy from the light source, and including a monomode optical fiber for carrying light waves;

(c) a detector, responsive to the waves from the interferometer, for producing a detector signal;

(d) a phase modulator, connected to the interferometer for modulating the phase of the wave(s) travelling through the interferometer;

(e) a polarizer and a spatial filter which are placed between the light source and the interferometer; and (f) an electronic means for controlling the phase modulator as a function of the detector signal in such a manner that:

(i) the variation of a demodulated error signal as a function of the difference of phase close to zero is sinusoidal; and (ii) this difference of phase is maintained at zero;

wherein the electronic means supplies a rotational speed signal which is a function of the speed of rotation of the interferometer about an axis perpendicular to a plane of the optical fiber; and wherein the electronic means includes:

(1) an analog-digital converter responsive to the detector for digitizing the detector signal and generating a digitized detector signal;

(2) a digital processing system, responsive to the analog-digital converter for utilizing the digitized detector signal and generating a processor signal reduced to a frequency of modulation around the optical fiber;

(3) a control loop digital filter, responsive to the processor signal, for supplying the rotational speed indication signal;

(4) a register for receiving the rotational speed indication signal and supplying a register signal which is a function of the speed of rotation;

(5) an accumulator, responsive to the register signal, for generating a digital feedback signal which is a function of the speed of rotation; and (6) a digital-analog converter, responsive to the digital feedback signal, for generating an analog feedback signal for controlling the phase modulator.

22. The system of claim 21, wherein the electronic means further comprises:

an adder, responsive to the digital feedback signal from the accumulator, for modulating the digital feedback signal before it is input to the digital-analog converter.

23. A current and magnetic-field sensor incorporating an optical in which a variation of difference of progression is produced by a measured parameter by the Faraday effect, the sensor comprising:

(a) a quasi-monochromatic light source;

(b) a SAGNAC ring interferometer receiving light energy from the light source, and including a monomode optical fiber for carrying light waves;

(c) a detector, responsive to the waves from the interferometer, for producing a detector signal;

(d) a phase modulator, connected to the interferometer for modulating the phase of the wave(s) travelling through the interferometer;

(e) a polarizer and a spatial filter which are placed between the light source and the interferometer; and (f) an electronic means for controlling the phase modulator as a function of the detector signal in such a manner that:

(i) the variation of a demodulated error signal as a function of the difference of phase close to zero is sinusoidal; and (ii) this difference of phase is maintained at zero;

wherein the electronic means supplies a parameter indication signal which is a function of the variation of the measured parameter; and wherein the electronic means includes:

(1) an analog-digital converter responsive to the detector for digitizing the detector signal and generating a digitized detector signal;

(2) a digital processing system, responsive to the analog-digital converter for using the digitized detector signal and generating a processor signal reduced to a frequency of modulation around the optical fiber;

(3) a control loop digital filter, responsive to the processor signal, for supplying the parameter indication signal;

(4) a register for receiving the parameter indication signal and supplying a register signal which is a function of the measured parameter;

(5) an accumulator, responsive to the register signal, for generating a digital feedback signal which is a function of the measured parameter; and (6) a digital-analog converter, responsive to the digital feedback signal, for generating an analog feedback signal for controlling the phase modulator.

24. The sensor of claim 23, wherein the electronic means further comprises:

an adder, responsive to the digital feedback signal from the accumulator, for modulating the digital feedback signal before it is input to the digital-analog converter.

* * * * *

UNITED STATES PATENT AND TRADEMARK OFFICE

CERTIFICATE OF CORRECTION

PATENT NO. : 5,039,220

DATED : August 13, 1991

INVENTOR(S) : Herve Jacques Arditty et al

It is certified that error appears in the above-identified patent and that said Letters Patent is hereby corrected as shown below:

On the title page, in item [73]:
Please correct the name of the Assignee from "Phononetics S.A."

to --Photonetics S.A.--

Signed and Sealed this

Third Day of November, 1992

*Attest:*

DOUGLAS B. COMER

*Attesting Officer*

*Acting Commissioner of Patents and Trademarks*